United States Patent [19]

Kitchin

[11] Patent Number: 4,936,392

[45] Date of Patent: Jun. 26, 1990

[54] ROAD SHOULDER GRADING ATTACHMENT

[76] Inventor: Kevin Kitchin, Ash Swamp Rd., Newmarket, N.H. 03857

[21] Appl. No.: 277,023

[22] Filed: Nov. 28, 1988

[51] Int. Cl.[5] ..... E02F 3/76

[52] U.S. Cl. ..... 172/815; 172/817; 172/831; 37/117.5

[58] Field of Search ..... 172/817, 810, 811, 828, 172/830, 782, 701.3, 815; 37/117.5, 281

[56] References Cited

U.S. PATENT DOCUMENTS

| | | | |
|---|---|---|---|
| Re. 28,979 | 6/1976 | Long et al. | 172/4.5 |
| 1,592,690 | 7/1926 | Wilson | 37/281 X |
| 2,310,396 | 2/1943 | Clinkscales, Jr. | 172/701.3 |
| 2,604,708 | 7/1952 | Washbond | 172/830 |
| 2,644,251 | 7/1953 | Smith | 37/117.5 |
| 2,645,866 | 7/1953 | McGee | 172/817 |
| 2,646,633 | 7/1953 | Jahn | 172/815 X |
| 3,094,796 | 6/1963 | Atchley | 37/156 |
| 3,109,351 | 11/1963 | Dunn | 94/44 |
| 3,127,689 | 4/1964 | Hopkins | 37/156 |
| 3,182,410 | 5/1965 | Schiavi | 37/179 |
| 3,229,391 | 1/1966 | Breitbarth et al. | 37/156 |
| 3,242,599 | 3/1966 | Iverson | 37/155 |
| 3,266,050 | 8/1966 | Reeder | 37/156 |
| 3,269,479 | 8/1966 | Macdonald | 180/22 |
| 3,312,504 | 4/1967 | Makinen | 299/24 |
| 3,330,365 | 7/1967 | Mathers | 172/548 |
| 3,435,546 | 4/1969 | Iverson | 37/108 |
| 3,440,744 | 4/1969 | Smith | 37/117.5 |
| 3,451,148 | 6/1969 | Funk | 37/110 |
| 3,539,014 | 11/1970 | Jonsson | 172/111 |
| 3,540,534 | 11/1970 | Rhoads | 171/63 |
| 3,552,498 | 1/1971 | Stauber | 172/783 |
| 3,665,622 | 5/1972 | Lamb | 37/117.5 |
| 3,693,722 | 9/1972 | Brown | 172/4.5 |
| 3,738,030 | 6/1973 | Olinger | 172/815 X |
| 3,786,871 | 1/1974 | Long et al. | 172/4.5 |
| 3,791,452 | 2/1974 | Long et al. | 172/4.5 |
| 3,815,686 | 6/1974 | Ryan | 172/783 |
| 3,852,945 | 12/1974 | Berry et al. | 56/12.7 |
| 3,856,089 | 12/1974 | Rivinius | 172/4.5 |
| 3,866,342 | 2/1975 | Cooper | 37/117.5 |
| 3,961,670 | 6/1976 | Rivinius | 172/4.5 |
| 4,007,667 | 2/1977 | Elias et al. | 92/60 |
| 4,109,336 | 7/1978 | Ford | 15/3 |
| 4,133,116 | 1/1979 | Devine et al. | 33/386 |
| 4,151,035 | 4/1979 | Jellison | 156/ |
| 4,156,466 | 5/1979 | Caldwell | 172/4.5 |
| 4,188,152 | 2/1980 | Kitt | 404/110 |
| 4,189,854 | 2/1980 | Haynes | 37/117.5 |
| 4,215,495 | 8/1980 | Wagner | 37/109 |
| 4,250,696 | 2/1981 | Hash | 56/14.7 |
| 4,256,142 | 3/1981 | Hancock | 137/596 |
| 4,328,628 | 5/1982 | Thomas | 37/117.5 |
| 4,463,507 | 8/1984 | Gaub | 37/117.5 |
| 4,597,205 | 7/1986 | Guest | 172/817 X |
| 4,643,261 | 2/1987 | Long | 172/2 |

OTHER PUBLICATIONS

"Barber-Greene Model 750 Road Widener" advertisement from Feb. 1989 issue of Highway & Heavy Construction.

Midland Machinery Co., Address: 101 Cranbrook Ext., Tonawanada, N.Y., U.S.A. 14150, "The Answer Machine for Loaders", Graders and Chipspreaders article re Widener Attachment.

*Primary Examiner*—Randolph A. Reese
*Assistant Examiner*—Jeffrey L. Thompson
*Attorney, Agent, or Firm*—Weingarten, Schurgin, Gagnebin & Hayes

[57] ABSTRACT

A road shoulder grading attachment movably attachable to the bucket of a front-end loader is provided. The attachment includes an upright grading blade attachable to the bucket of the loader in an angled position forward of the bucket. The attachment also includes support structure for rigidly attaching the blade to the bucket and means for raising the blade out of the path of the bucket so that when the attachment is mounted on the bucket of the loader, normal use of the bucket is possible.

6 Claims, 4 Drawing Sheets

ROAD SHOULDER GRADING ATTACHMENT

FIELD OF THE INVENTION

This invention relates to road shoulder qradinq equipment and more particularly to a road shoulder grading attachment mountable to the bucket of a front-end loader.

BACKGROUND OF THE INVENTION

Road grading material, such as road cinders, is deposited along the shoulder area of roads and highways to provide a stable surface upon which vehicles can stop out of traffic, to provide a boundary zone between a road surface and roadside vegetation, and to provide a drainage area for water. By one method, grading material is incrementally deposited on a road and its shoulder area from the tilted bed of a dumptruck, and is then spread over the road shoulder area by at least one conventional road grader, for example, a Galion model A-550, or a Caterpillar model 12G, following the dumptruck.

The disadvantage of such a method, however, is that conventional road graders are large and expensive, and are designed for grading wide expanses of road area. Because of their size and large turning radii, conventional road graders are not maneuverable and are not ideally suited for road shoulder work. Should a particular section of a road shoulder area require special attention and therefore extra grading, a conventional road grader would be required to perform the extra grading by completing a series of passes over the area, each of which would require clumsy repositioning of the grader.

By another method, road shoulder grading can be accomplished by use of a shoulder paving machine, called the Widener Attachment, manufactured by Midland Machinery Company of Tonawanda, New York. The machine can be mounted to a front-end loader, a conventional road grader, or a chipspreader, and contains a conveyor system and a road shoulder spreader. To perform the grading, the machine, mounted on the front-end loader, road grader or chipspreader, travels in contact with a dump truck which distributes from its tilted bed the grading material to the conveyor system of the shoulder paving machine. The conveyor system transfers the grading material to the road shoulder area whereupon the spreader grades it evenly over the road shoulder area.

Disadvantages of the Midland shoulder paving machine, however, are that the machine is complicated and expensive, and is even less maneuverable than a conventional road grader. The Midland shoulder paving machine, therefore, cannot rework road shoulder areas requiring extra grading. Furthermore, the Midland machine is attached to the front-end loader, road grader or chipspreader in such a way that normal use of the loader, grader or chipspreader is prevented. For example, if the Midland shoulder paving machine is used with a front-end loader, the bucket of the loader must be removed and the Midland machine must be attached to the lift arms of the loader. Therefore, while the Midland machine is attached to a loader, the loader, cannot be used to lift, transport or dump anything.

SUMMARY OF THE INVENTION

In brief, the present invention is a road shoulder grading attachment removably mountable to the bucket of a front-end loader. The attachment is comprised of an upright blade firmly attachable to the bucket in an angled position forward of the bucket by blade supports, movable linkages and at least one hydraulic actuator. When the attachment is mounted to the bucket, the blade is positioned such that its bottom edge is capable of confronting a road surface and its road shoulder area to be graded, yet the blade is also mounted such that it can be lifted upwards from the road surface and shoulder area out of the path of the front edge of the bucket so that the bucket can be used in a normal manner to lift, transport or dump materials.

The blade is dimensioned wider than the bucket such that when the blade is in a position for grading, a portion of the blade extends, when viewed from the operator's position of the front-end loader, beyond the right edge of the bucket into the area which corresponds to the road shoulder area to be graded. On this extended portion of the blade, an adjustable grading edge is mounted on the bottom edge of the blade to control the height of the grading material spread over the road shoulder area. Flanges formed on the ends of the blade prevent flow of grading material around the edges of the blade, and a replaceable wear edge attached to the bottom of the blade Protects the bottom edge of the blade from scraping and denting.

The advantages of the present invention over the methods discussed above are that the present invention is inexpensive, simple, light weight, and can be used with even small front-end loaders, such as Bobcat loaders. Also, the present invention easily and quickly attaches to and removes from the bucket of the front-end loader, and does not impair use of the bucket when attached.

Grading can also be performed more quickly and easily with the present invention than by use of the methods described above because the present invention is relatively small and lightweight and because front-end loaders, to which the present invention attaches, are much more maneuverable than conventional graders and the Midland shoulder paving machine used with a loader, grader or chipspreader. Therefore, a front-end loader equipped with the present invention can quickly reposition itself for multiple passes over a road shoulder area that requires extra grading.

Also, as the blade of the present invention can be raised out of the way of the bucket of the front-end loader, the bucket can be used in a normal manner to quickly scoop and reposition large quantities of grading material around road shoulder areas that require special attention. Neither conventional graders, nor the Midland shoulder paving machine possess this capability.

DESCRIPTION OF THE DRAWINGS

The invention will be more fully understood from the following detailed description provided in conjunction with the accompanying drawings, in which.

DETAILED DESCRIPTION OF THE INVENTION

Figure 1:
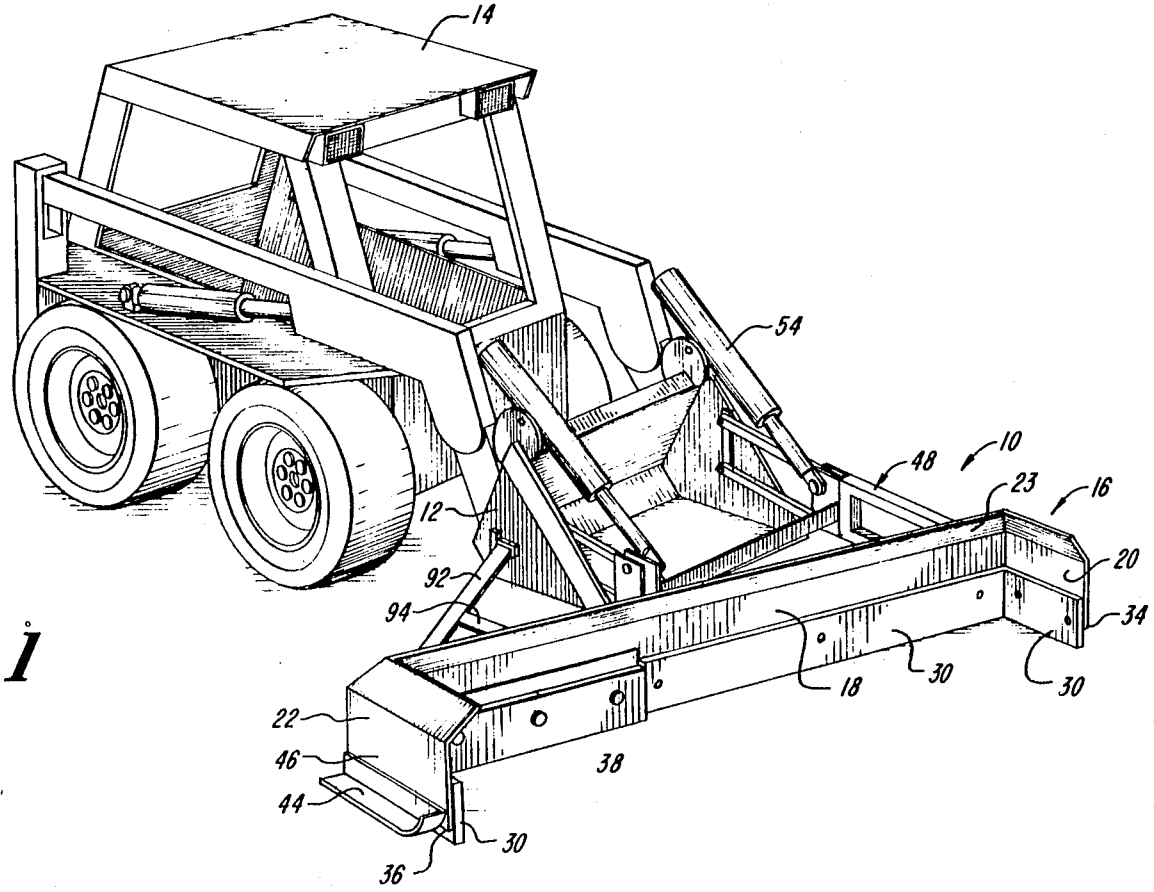
FIG. 1 is a perspective view of the present invention mounted to the bucket of a Bobcat front-end loader.

Referring to FIG. 1, which shows the preferred embodiment of the present invention, road shoulder grading attachment 10 is attached to the bucket 12 of front-end loader 14. As can be seen from the drawings, road shoulder grading attachment 10 includes blade 16 and means for mounting blade 16 on bucket 12.

Blade 16 is made of steel plate and is comprised of backplate 18, which acts as a grading plane to guide grading material to and over the road shoulder area. Flanges 20 and 22 are formed on the ends of backplate 18 to prevent grading material from flowing around the ends of blade 16, and lip 23 is formed on the tops of backplate 18 and flanges 20 and 22 to prevent grading material from flowing over the top of the backplate and the flanges.

Figure 3:
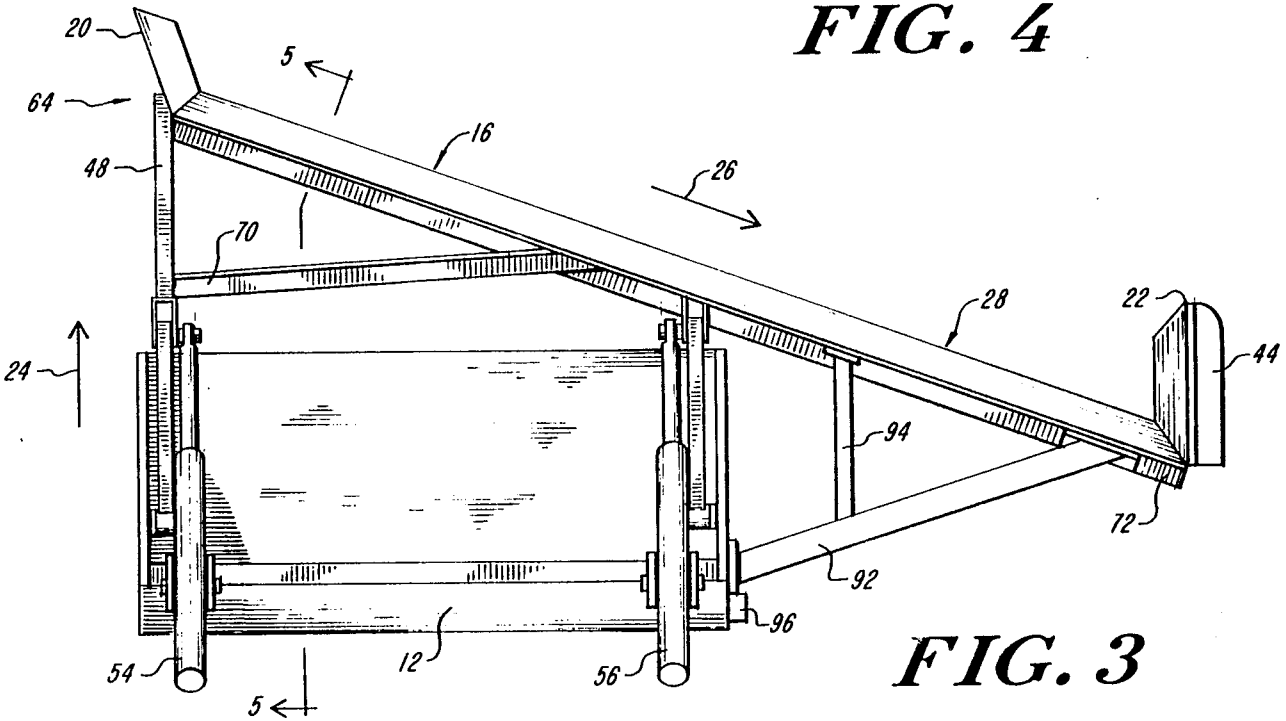
FIG. 3 is a top elevation view of the embodiment of the invention shown in FIG. 1.

As best can be seen in FIG. 3, blade 16 is dimensioned wider than bucket 12 and is mounted such that, when viewed from the operator's position of the front-end loader when the blade is in a position for grading, a portion of blade 16 extends beyond the right side of bucket 12 into the area which corresponds to the road shoulder area to be graded. Also, as can be seen in FIG. 3, blade 16 is mounted to bucket 12 at an angle such that when blade 16 is moved forward during grading in the normal direction of grading, as indicated by arrow 24, grading material (not shown) is guided as indicated by arrow 26 to the area of the extended portion 28 of the blade over the road shoulder area.

Figure 4:
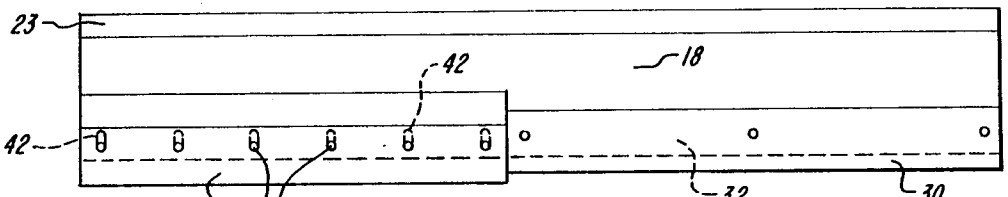
FIG. 4 is a front plan view of the blade (without flanges) of the embodiment of the invention shown in FIG. 1.

A wear edge 30, which can be made of plate steel, hard plastic or teflon, is bolted or otherwise replaceably attached to the bottom edges 32, 34 and 36 of backplate 18 and flanges 20 and 22. During grading, wear edge 30 contacts the surface of the area to be graded, and thereby protects the bottom edges of backplate and flanges 20 and 22 from scrapes and dents. An adjustable grading edge 38, which also can be made of plate steel, hard plastic or teflon, is mounted on backplate 18 at extended portion 28 of blade 16 in place of wear edge 30 to control the height of the grading material spread over the road area. As can best be seen in FIG. 4, adjustable grading edge 40 is attached to backplate 18 by means of bolts 40 and slotted holes 42 which permit adjustable grading edge 38 to be positioned to a desired grading height. A blade edge shoe 44, made of angle iron rolled at one end, is welded, bolted, or otherwise rigidly attached to lower outer surface 46 of flange 22 formed on extended portion 28 of blade 16 to prevent the bottom edge 36 of the flange from catching on objects during grading.

Figure 2:
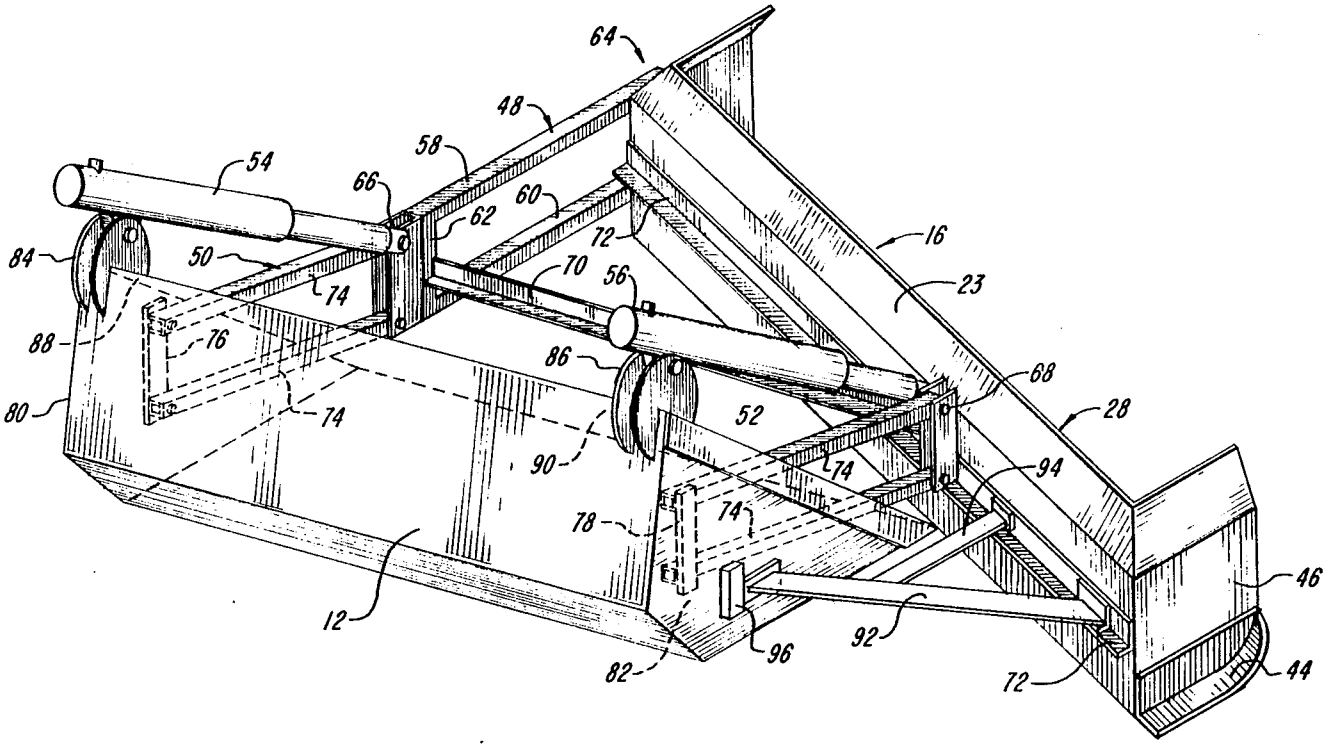
FIG. 2 is a back perspective view of the embodiment of the invention shown in FIG. 1.

As can best be seen in FIG. 2, the means for mounting blade 16 to bucket 12 includes blade support 48, parallelogram linkages 50 and 52, and hydraulic actuators 54 and 56. Blade support 48, made of square tubular steel, is roughly "C" shaped and is comprised of horizontal members 58 and 60 and short vertical member 62. Horizontal members 58 and 60 each have an end welded or otherwise rigidly attached to left end 64 of blade 16. The opposite ends of horizontal members 58 and 60 are connected together by short vertical member 62.

Onto short vertical member 62 and the back of blade 16 at approximately the midpoint of the blade, blade mounting brackets 66 and 68, fashioned of plate steel, are welded or otherwise rigidly attached. Also, a transverse support arm 70, which extends roughly parallel to the front edge of bucket 12, is welded or otherwise rigidly attached to vertical member 62 of blade support 48 and to the back of blade 16 to provide lateral rigidity to the invention. Blade stiffener 72, made of angle iron as shown in the drawings, or square or round steel tubing, is welded or otherwise rigidly attached to the back of blade 16 to give the blade support and to control blade flex.

The means for mounting blade 16 further includes parallelogram linkages 50 and 52 and hydraulic actuators 54 and 56 which provide a means for raising blade from the path of bucket 12. Parallelogram linkages 50 and 52, made of square tubular steel, are comprised of parallel horizontal struts 74 having ends which rotatably attach to blade mounting brackets 66 and 68 and blade mounting plates 76 and 78. Blade mounting plates 76 and 78, made of thick plate steel, are welded or otherwise rigidly attached to the inside surfaces of sides 80 and 82 of bucket 12 to provide areas on the bucket strong enough to absorb the stress of the present invention. Parallel horizontal struts 74 are attached to pairs of vertically spaced holes drilled through the sides 80 and 82 of bucket 12, blade mounting plates 76 and 78, and blade mounting brackets 66 and 68 by means of bolts and sleeves with grease fittings.

Conventional hydraulic actuators 54 and 56, which provide the power to raise and lower blade 16, attach at the upper holes of blade mounting brackets 66 and 68 and at hydraulic actuator mounting brackets 84 and 86, disposed on bucket 12, by means of bolts and sleeves with grease fittings. Hydraulic actuator mounting brackets 84 and 86 are fashioned of plate steel and are welded, bolted or otherwise rigidly attached to bucket 12 on the upper left and right edge 88 and 90 of the bucket, as shown in FIG. 2.

Optional blade extension support struts 92 and 94, made of square tubular steel, can be bolted or otherwise rigidly attached to the back of the extended portion 28 of blade 16 to impart additional rigidity to the extended portion of the blade. Blade extension support struts 92 and 94, however, would not attach to bucket 12, but merely would rest against side 82 of the bucket and against stop 96, which can be made of steel welded or otherwise rigidly attached to side 82 of the bucket, when blade 16 is in a position for grading. Blade extension support struts 92 and 94 therefore would move with blade 16 as it is raised and lowered by hydraulic actuators 54 and 56.

Figure 5A:
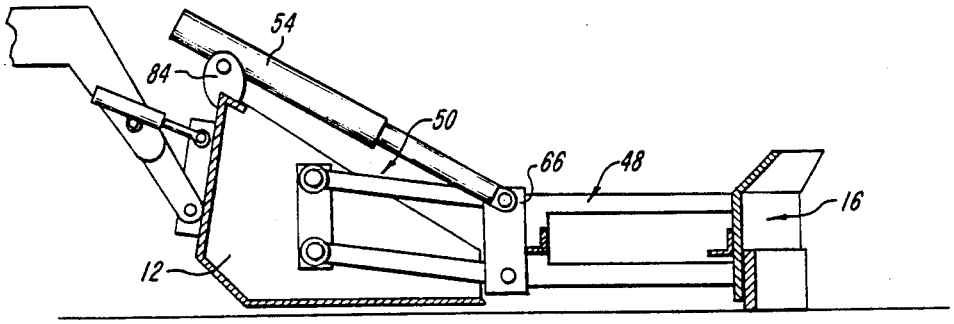
FIGS. 5A, 5B and 5C are cutaway elevation views, taken along line 5—5 of FIG. 3, of the embodiment of the present invention shown in FIG. 1, and demonstrating how the blade can be raised from the path of the bucket and how the present invention does not impair use of the bucket.
Figure 5B:
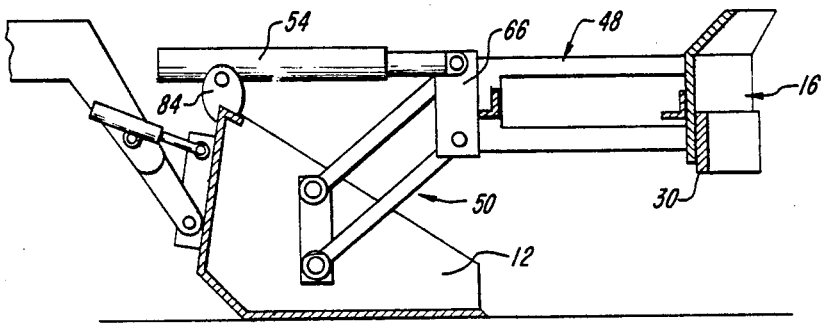
Figure 5C:
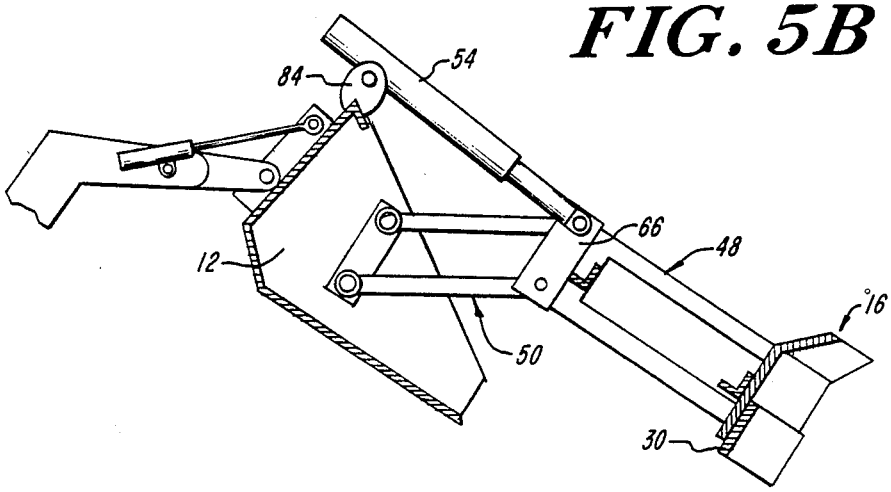

FIGS. 5A, 5B and 5C demonstrate that blade 16 of the present invention can be raised from the path of bucket 12 and out of a normal position for grading. As hydraulic actuator 54 retracts, blade 16 and its support structure are raised out of the path of bucket 12. As hydraulic actuator 54 extends, blade 16 and its support structure are lowered to their original normal position for grading. FIG. 5C also demonstrates that in the raised position, the present invention does not interfere with the movement of bucket 12. Therefore, with the present invention in a raised position, bucket 12 can be used in a normal manner to scoop, lift, transport and dump materials.

The present invention is used much like a conventional road grader. A dump truck incrementally deposits grading material on a road and its shoulder area to be graded. At least one front-end loader fitted with the present invention follows the dump truck and uses blade 16 in a manner well known to spread the grading material over the road shoulder area. Should the road shoulder area require special attention, the loader fitted with the present invention can quickly reposition itself and make one or more additional passes over the area until the desired grading is completed. If needed, blade 16 can also be quickly raised and bucket 12 can be used in a conventional manner to reposition large quantities of grading material. Thereafter, blade can be lowered and grading can be resumed.

It should be appreciated that this detailed description discloses the presently preferred embodiment of the invention, and that other embodiments within the scope of this invention can be devised. For example, means other than what has been disclosed above can be developed for mounting blade 16 onto bucket 12 and means other than the means disclosed above can be developed for raising and lowering blade 16 from the path of bucket 12. Furthermore, other materials can be substituted for those described above without departing from the scope of the present invention. Therefore, the present invention should not be considered to be limited by what has been described above and is only limited by the following claims.

What is claimed is:

1. An attachment mountable to the bucket of a front-end loader for grading the road shoulder area of a road surface by spreading deposited grading material over the road shoulder area, comprising:

a grading blade having a first portion adapted to confront the road surface and having a second portion adapted to confront and grade the road shoulder area; and means for mounting said grading blade onto the bucket of the front-end loader in an upright, angled position forward of the bucket, wherein said first portion of said grading blade is capable of confronting the road surface and said second portion of said grading blade is capable of confronting and grading the road shoulder area, and wherein said first portion of said grading blade guides the grading material to said second portion of said grading blade when said blade is moved during grading by the front-end loader in a normal direction of grading;

said means for mounting said grading blade further including means for raising and lowering said grading blade, with respect to the bucket of the front-end loader, into and out of said upright, angled position forward of the bucket, wherein the bucket may be used in a conventional manner without the detachment of said grading blade therefrom.

2. The attachment of claim 1, wherein said means for raising and lowering said grading blade includes at least one hydraulic actuator.

3. The attachment of claim 1, wherein said means for raising and lowering said grading blade includes at least one parallelogram linkage.

4. An attachment mountable to a bucket, having opposing vertical sides and a forward edge, of a front-end loader for grading the road shoulder area of a road surface by spreading deposited grading material over the road shoulder area, comprising:

a grading blade having a first portion adapted to confront the road surface and having a second portion adapted to confront and grade the road shoulder area;

a support structure attached to said grading blade for mounting said grading blade onto the bucket of the front-end loader in a position upright and forward of the bucket at an angle to the forward edge of the bucket, wherein said first portion of said grading blade is capable of confronting the road surface and said second portion of said grading blade is capable of confronting and grading the road shoulder area, wherein said first portion of said grading blade guides the grading material to said second portion of said grading blade when said blade is moved during grading by the front-end loader in a normal direction of grading, and wherein said support structure is attachable to the bucket of the front-end loader to mount said grading blade in said position;

at least one actuator having first and second attachment points which move in relation to each other upon actuation of said actuator, wherein said first attachment point is attached to said support structure and said second attachment point is attached to said front-end loader;

wherein said support structure includes at least one movable portion; and wherein said actuator and said movable portion are capable of cooperating to raise and lower said grading blade, with respect to the bucket of the front-end loader, into and out of said position upright and forward of the bucket while maintaining said angle between said grading blade and the bucket, wherein the bucket may be used in a conventional manner without detachment of said grading blade therefrom.

5. The attachment of claim 4, wherein said support structure includes:

a first support arm having an end attached to said first portion of the said grading blade and having an opposite end attachable to one of the vertical sides of the bucket of the front-end loader;

a second support arm spaced apart from said first support arm and having an end attached to said grading blade and an opposite end attached to the opposite vertical side of the bucket of the front-end loader; and wherein the length of the said first support arm is longer than the length of the said second support arm by a selected distance which determines said angle of said grading blade when said support structure is attached to the bucket of the front-end loader.

6. The attachment of claim 5, further comprising:

at least one hydraulic actuator having first and second attachment points movable in relation to each other upon actuation of said hydraulic actuator, wherein said first attachment point is attached to one of said first and second support arms and said second attachment point is attached to the bucket of the front-end loader;

wherein each of said first and second support arms includes a parallelogram linkage; and wherein said hydraulic actuator and said parallelogram linkages are capable of cooperating to raise and lower said grading blade into and out of said position upright and forward of the bucket of the front-end loader at said angle.

* * * * *